US005574490A

United States Patent [19]

Gragg et al.

[11] Patent Number: 5,574,490

[45] **Date of Patent: *Nov. 12, 1996**

[54] INK JET HARD COPY APPARATUS INK CARTRIDGE

[75] Inventors: Brian D. Gragg, San Diego, Calif.; James E. Clark, Albany, Oreg.; David W. Swanson, Escondido, Calif.; George T. Kaplinsky; Tofigh Khodapanah, both of San Diego, Calif.

[73] Assignee: Hewlett-Packard Company, Palo Alto, Calif.

[ * ] Notice: The term of this patent shall not extend beyond the expiration date of Pat. No. 5,440,333.

[21] Appl. No.: 170,951

[22] Filed: Dec. 21, 1993

Related U.S. Application Data

[63] Continuation-in-part of Ser. No. 929,615, Aug. 12, 1992, abandoned, which is a continuation of Ser. No. 240,297, May 9, 1994.

[51] Int. Cl.[6] ..... B41J 2/175

[52] U.S. Cl. ..... 347/87

[58] Field of Search ..... 347/86, 87, 43; 222/92, 95, 96, 105, 481; B41J 2/175

[56] References Cited

U.S. PATENT DOCUMENTS

| | | | |
|---|---|---|---|
| 4,422,084 | 12/1983 | Saito et al. | 347/86 X |
| 4,719,475 | 1/1988 | Kiyohara et al. | 347/86 |
| 4,771,295 | 9/1988 | Baker et al. | 347/87 |
| 5,119,115 | 6/1992 | Buat et al. | 347/86 |
| 5,280,300 | 1/1994 | Fong et al. | 347/87 |
| 5,315,317 | 5/1994 | Terasawa et al. | 347/86 X |
| 5,359,353 | 10/1994 | Hunt et al. | 347/86 |
| 5,440,333 | 8/1995 | Sykora et al. | 347/87 |

*Primary Examiner*—Alrick Bobb

[57] ABSTRACT

A collapsible ink reservoir structure to facilitate assembly of a replaceable or refillable printer ink cartridge is comprised of a relatively rigid inner frame and flexible membranes forming an ink reservoir having side walls which collapse to a substantially flat shape to minimize the amount of ink remaining in the reservoir structure after computer generated printing has depleted the ink from the cartridge. The reservoir structure is a separate unit from the ink discharge aperture device which is assembled and mounted in an outer housing and includes the inner frame and ink bags formed of films to form the cartridge assembly. Multiple reservoirs can be formed within the structure to permit the use of different colorants in each reservoir. The structure preferably contains an ink pressure regulator within each reservoir to maintain a negative pressure therein.

19 Claims, 4 Drawing Sheets

INK JET HARD COPY APPARATUS INK CARTRIDGE

CROSS-REFERENCE TO RELATED APPLICATIONS

This is a continuation-in-part of application Ser. No. 07/929,615, filed Aug. 12, 1992, now abandoned, COLLAPSIBLE INK RESERVOIR STRUCTURE AND PRINTER INK CARTRIDGE, Kaplinsky et al. which is a continuation of Ser. No. 08/240,297, filed May 9, 1994, incorporated herein by reference.

The present invention is also related to the following U.S. patent applications to the common assignee herein, the entire disclosures of which are incorporated herein by this reference:

- NEGATIVE PRESSURE INK DELIVERY SYSTEM, Ser. No. 07/995,851, filed Dec. 23, 1992 (Kaplinsky, et al.);
- COMPACT FLUID COUPLER FOR THERMAL INK JET PRINT CARTRIDGE AND RESERVOIR, Ser. No. 07/853,372, filed Mar. 18, 1992 (Salter); U.S. Pat. No. 5,464,578;
- INK PRESSURE REGULATOR FOR A THERMAL INK-JET PRINTER, Ser. No. 07/928,811, filed Aug. 12, 1992, (Khodapanah et al.); U.S. Pat. No. 5,541,63
- TWO MATERIAL FRAME HAVING DISSIMILAR PROPERTIES FOR A THERMAL INK-JET CARTRIDGE, Ser. No. 07/994,807, filed Dec. 22, 1992 (Swanson et al.); U.S. Pat. No. 5,515,092;
- RIGID LOOP CASE STRUCTURE FOR THERMAL INK-JET PEN, Ser. No. 07/994,808, filed Dec. 22, 1992 (Swanson et al.); U.S. Pat. No. 5,451,995;
- THERMAL INK-JET PEN WITH A PLASTIC/METAL ATTACHMENT FOR THE COVER, Ser. No. 07/994,810, filed Aug. 12, 1992 (Timm et al.);
- INK CARTRIDGE FOR A HARD COPY PRINTING OR PLOTTING APPARATUS, Ser. No. 08/170,840, filed concurrently herewith; U.S. Pat. No. 5,467,118.
- THIN PEN STRUCTURE FOR THERMAL INK-JET PRINTER, Ser. No. 07/994,809, file Dec. 22, 1992 (Swanson et al.); U.S. Pat. No. 5,491,502;
- DOUBLE COMPARTMENT INK-JET CARTRIDGE WITH OPTIMUM SNOUT, Ser. No. 07/995,221, filed Dec. 22, 1992 (Swanson et al.);
- LAMINATED FILM INK RESERVOIR, Ser. No. 07/995,868, filed Dec. 22, 1992 (Scheffelin); U.S. Pat. No. 5,450,112;
- TWO MATERIAL FRAME HAVING DISSIMILAR PROPERTIES FOR THERMAL INK-JET CARTRIDGE, Ser. No. 08/058,730, filed May 3, 1993, (Chundury); and
- SPRING BAG PRINTER INK CARTRIDGE WITH VOLUME INDICATOR, Ser. No. 07/717,735, filed Jun. 19, 1991 (Hunt et al.) U.S. Pat. No. 5,359,353.

BACKGROUND OF THE INVENTION

1. Field of the Invention

The present invention relates generally to ink cartridges for high speed computer driven printers such as ink-jet printers and plotters and, more particularly, to reservoir systems for ink cartridges having capabilities for media marking in multi-color applications.

2. Description of the Related Art

In the field of ink-jet printing, ink (or "colorant") may be kept in a reservoir and maintained under a sub-atmospheric (or "negative") pressure, so that ink will not leak, also referred to in the art as "drool," from the printhead attached to the reservoir. Such a printer cartridge is described in U.S. patent application Ser. No. 995,851 (Kaplinsky) referenced and incorporated above.

Various types of ink reservoirs have been used, including both disposable and refillable ink reservoir cartridges which are mounted on a moveable printer carriage, and remote, or "off-board," ink reservoirs from which ink is drawn to the printhead through a tubing system.

In the on-board, disposable or refillable, ink reservoir cartridges of the prior art, a polymer foam is ordinarily provided in the ink reservoir so that capillary action of the foam will prevent ink from drooling inappropriately from the printhead. Polymeric foams of the type typically used for this purpose are non-biodegradable and thus cause environmental problems whenever an expended cartridge is discarded. In addition, the use of industrial foam in the ink reservoir restricts the operating pressure range of the ink cartridge and can leave a chemical residue which is incompatible or reacts adversely with printer ink.

Similarly, the relatively long tubing used to convey ink from an off-board pressure reservoir to a printhead does not lend itself well for different printing pressure ranges.

Therefore, there is a need for an on-board ink reservoir system for printers and plotters that does not rely upon foam-based ink retention mechanisms.

SUMMARY OF THE INVENTION

In its basic aspect, the present invention comprises an ink reservoir structure, enclosed within a printer ink cartridge, in which ink is to be maintained under negative pressure. Said structure includes a substantially rigid frame having a pair of peripherally extending edges on opposite sides thereof and at least a first and second ink discharge port therethrough, and at least three flexible, ink-impervious membranes, sealingly joined around the peripheries thereof, forming at least two ink reservoirs in fluid communication with said first and second ink discharge ports, respectively.

A printer ink cartridge device, containing an ink reservoir adapted to maintain ink under a negative pressure with respect to a printhead connected to said cartridge device, is disclosed which includes: a substantially rigid housing having a pair of peripheral edges on opposite sides thereof, a pair of cover plates, each cover plate adapted to mate with one of said peripheral edges to form an enclosure, and at least first and second ink discharge ports through said housing; at least three flexible, fluid impervious membranes, sealingly joined internally of said housing to form a first and second ink reservoir for holding ink, each reservoir adapted to be in fluid communication with one of said first and second ink discharge ports respectively; and at least two means for regulating pressure, one each within each said first and second reservoir respectively, each adapted to maintain said negative pressure for each said reservoir.

It is an advantage of the present invention to provide a collapsible ink reservoir structure and a printer ink cartridge container which is easy to construct.

It is another advantage of the present invention to provide a multicolor ink reservoir structure.

It is still another advantage of the present invention to provide independent, controllable, pressure regulation in multicolor ink reservoir structure.

It is yet another advantage of the present invention to provide an ink cartridge of a compact design.

Other objects, features and advantages of the present invention will become apparent upon consideration of the following detailed description and the accompanying drawings, in which like reference designations represent like features throughout the FIGURES.

The drawings referred to in this description should be understood as not being drawn to scale except if specifically noted.

DETAILED DESCRIPTION OF THE INVENTION

Reference is made now in detail to a specific embodiment of the present invention, which illustrates the best mode presently contemplated by the inventor(s) for practicing the invention. Alternative embodiments are also briefly described as applicable. While the invention is discussed in terms of an ink-jet printer system, it will be apparent to those skilled in the art that the embodiments disclosed are readily adaptable to other types of printers and plotters.

Figure 1:
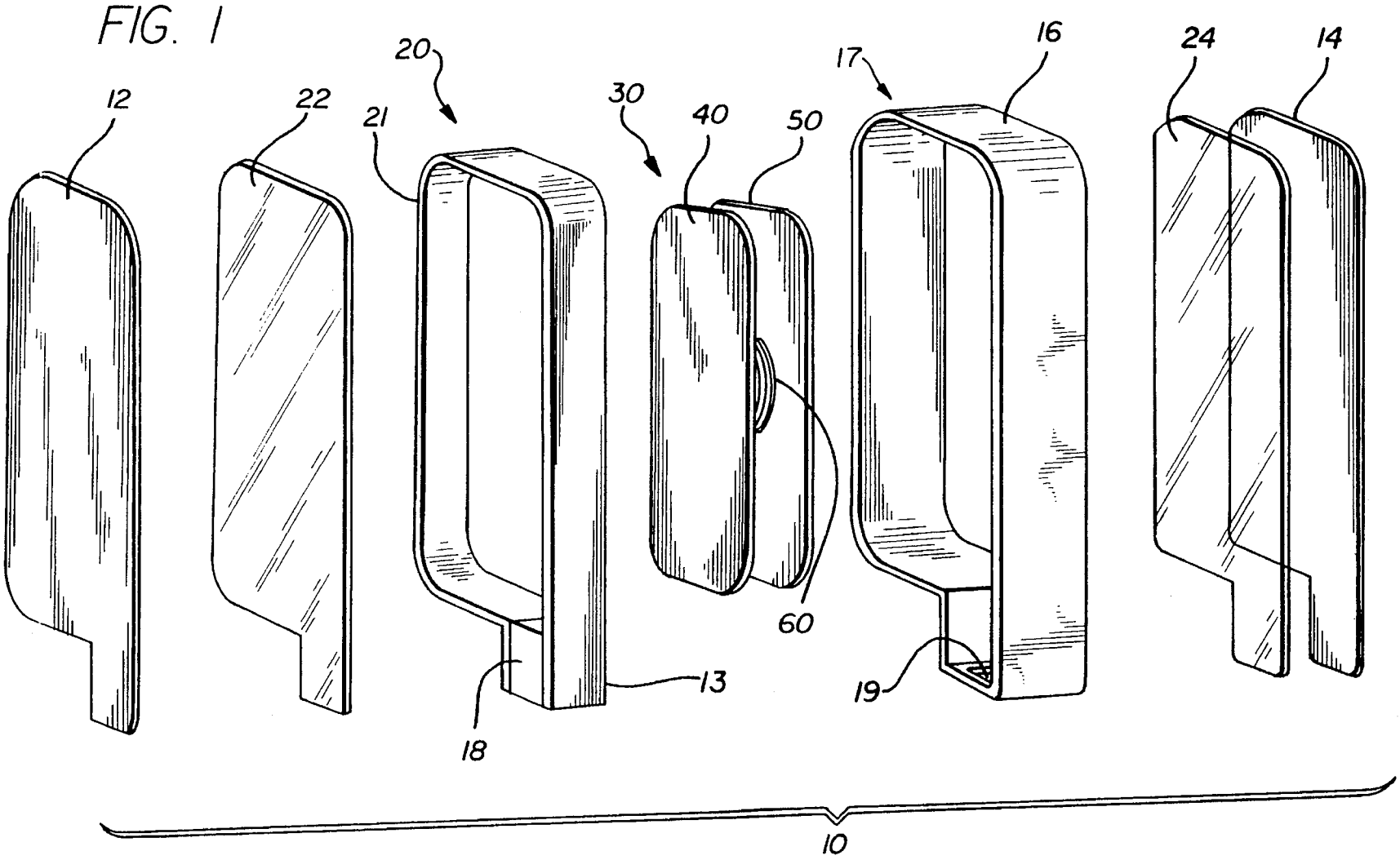
FIG. 1 is an exploded, perspective view of a disposable or refillable ink cartridge for a thermal ink-jet printer containing a collapsible ink reservoir structure.
Figure 2:
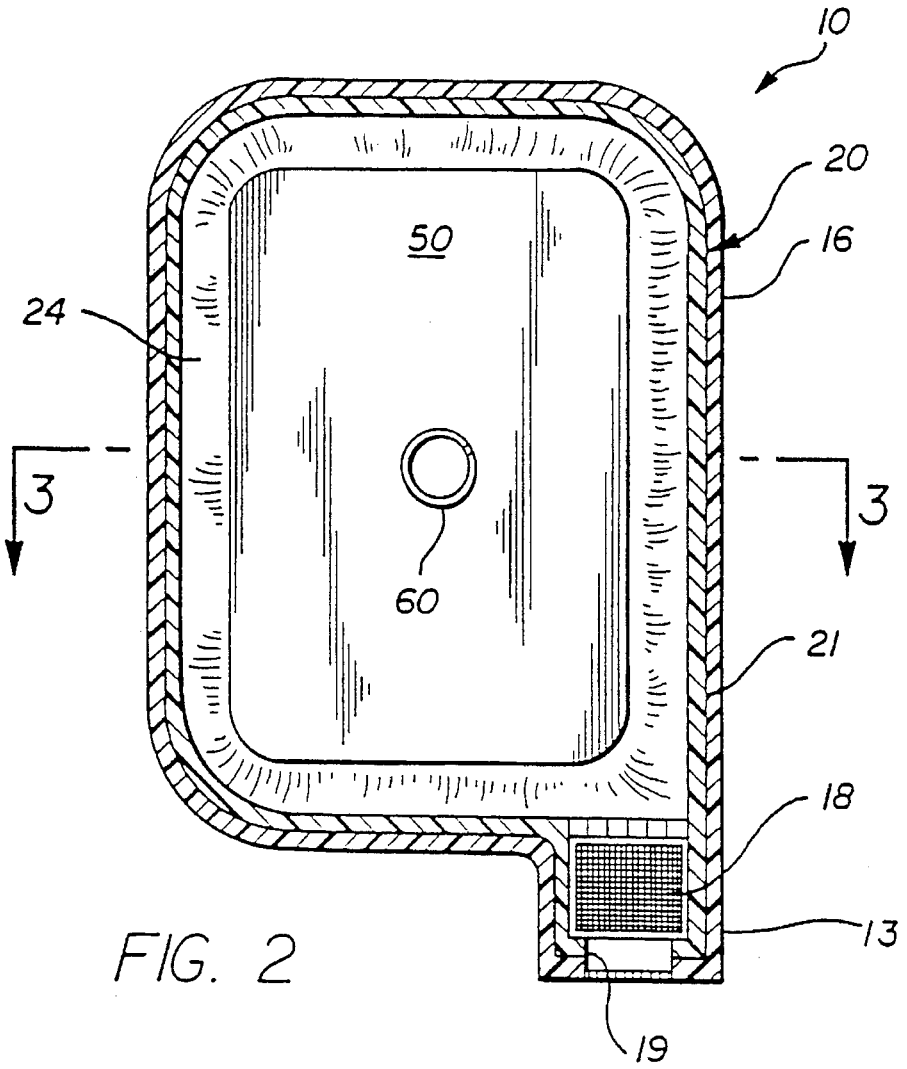
FIG. 2 is a vertical cross-section of the cartridge of FIG. 1.

A replaceable ink cartridge 10 is seen in FIG. 1 to comprise a rigid outer housing 17, having a pair of spaced cover plates 12, 14 intended to be affixed, such as by press-fit, cementing, ultrasonic welding, or the like, to opposite side edges of a plastic peripheral wall section 16 to form a closed cavity. A snout portion 13 of the housing 10 located at the lowermost portion of the peripheral outer housing wall 16 as viewed in FIG. 1, is provided with an ink discharge aperture 19 (FIG. 2) through which ink is downwardly discharged through a filter 18 to an electrically driven printhead (not shown) generally having a nozzle plate with orifices for ejecting ink from the printhead to a print media.

A reservoir structure unit, comprised of a relatively rigid plastic inner frame 20 and flexible ink bag membranes 22, 24 attached thereto, is mounted within the plastic wall section 16.

Alternatively, in the preferred embodiment, the inner frame 20 can be formed integrally with the outer housing 17 in an injection molding process. Preferably, the inner frame 20 is formed of a softer and lower melting point plastic than the outer housing 17 and of a material compatible so as to permit a sealing heat bonding of the membranes 22, 24 thereto. Such can be accomplished in a two-step molding process as is disclosed in co-pending application Ser. Nos. 994,807 and 058,730, referenced and incorporated above. The inner frame 20 may be constructed with some flexibility to assist in mounting it within the interior of the wall section 16 of outer housing 17, but is rigid relative to the flexible membranes described below.

The inner frame 20 has a pair of opposite side edges 21 to which a pair of flexible membranes 22, 24 are respectively joined, such as by heat welding at their peripheral edges to form the reservoir structure. The membranes are of a material that is fluid impervious to the ink to be contained within a reservoir section.

The reservoir structure preferably contains a pressure regulator 30. The reservoir structure pressure regulator 30 is comprised of a pair of spaced substantially parallel plates 40, 50 which are urged apart by a spring 60 and into engagement with the flexible membranes 22, 24. Thus, negative pressure is maintained as more fully described in co-pending application Ser. No. 995,851, as referenced and incorporated above.

The assembled reservoir structure, including the inner frame 20, membranes 22, 24, and pressure regulator 30, is then mounted inside of wall section 16 of the cartridge. The side walls 12, 14 are then affixed to the cartridge housing peripheral wall 16.

The snout portion 13 of housing 10 also contains an ink filter 18 which is placed in fluid communication with the flexible ink bag reservoir. The filter 18 may be mounted inside the reservoir structure or positioned outside of the reservoir structure but inside outer housing 17 with minor porting and sealing modifications to ensure proper fluid communication from the ink reservoir to the filter 18. Such ink filters are discussed in U.S. Pat. No. 4,771,295 (Baker et al.), held by the common assignee herein and incorporated by reference, and U.S. patent application Ser. No. 07/995,109, incorporated herein by reference, referenced and incorporated above.

Figure 3:
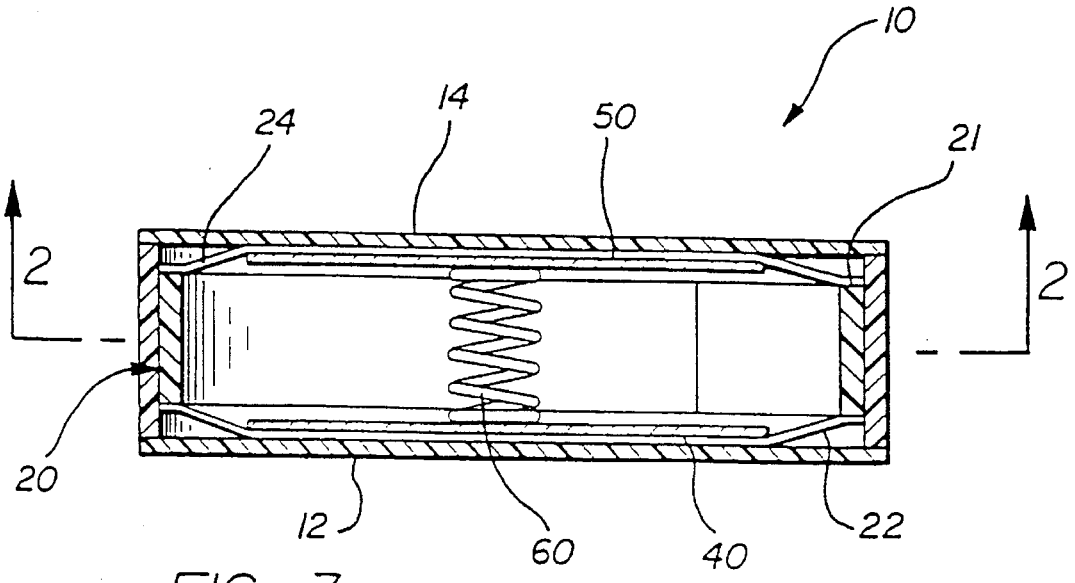
FIG. 3 is a cross-sectional plan view of the cartridge of FIG. 1.

Referring now to FIG. 3, pressure regulator side plates 40, 50 are of generally rectangular configuration with rounded corners to avoid damaging the flexible bag membranes 22, 24. Prior to or simultaneous with attachment of the membranes 22, 24 to the sides of inner frame 20, the regulator 30 is placed in the inner frame 20 by collapsing it partially against the spring force such that it initially occupies a prestressed condition inside the ink bag formed by the inner frame 20 and the membranes 22, 24. The amount of this prestressing is readily controllable by the designer by selecting a desired degree of compression of the spring 60.

As is known in the art, ink is introduced into the assembled cartridge, generally by injecting ink into the cartridge through a pluggable aperture (not shown) through the frame members.

In operation, the flexible membranes 22, 24 and the pressure regulator sideplates 40, 50 gradually move towards each other as the reservoir is evacuated of ink. The membranes 22, 24 are sized with enough extra membrane material near their edges of attachment to the inner frame 20 such that they are freely moveable with the side plates between full and empty positions as best indicated in FIG. 3. This permits most of the ink in the reservoir structure to be used before the cartridge is discarded, or refilled as the case may be.

Ideally, both sideplates 40, 50 and the spring 60 are made of a non-corrosive metal, such as stainless steel, and the inner frame 20 and the bag membranes 22, 24 are made of inert plastics which do not react with print ink. As will be recognized by a person skilled in the art, the regulator mechanism need not be mounted internally to the reservoir. A wide range of variations are envisioned by the inventors which would perform the same negative pressure function at the ink discharge aperture 19.

Figure 4:
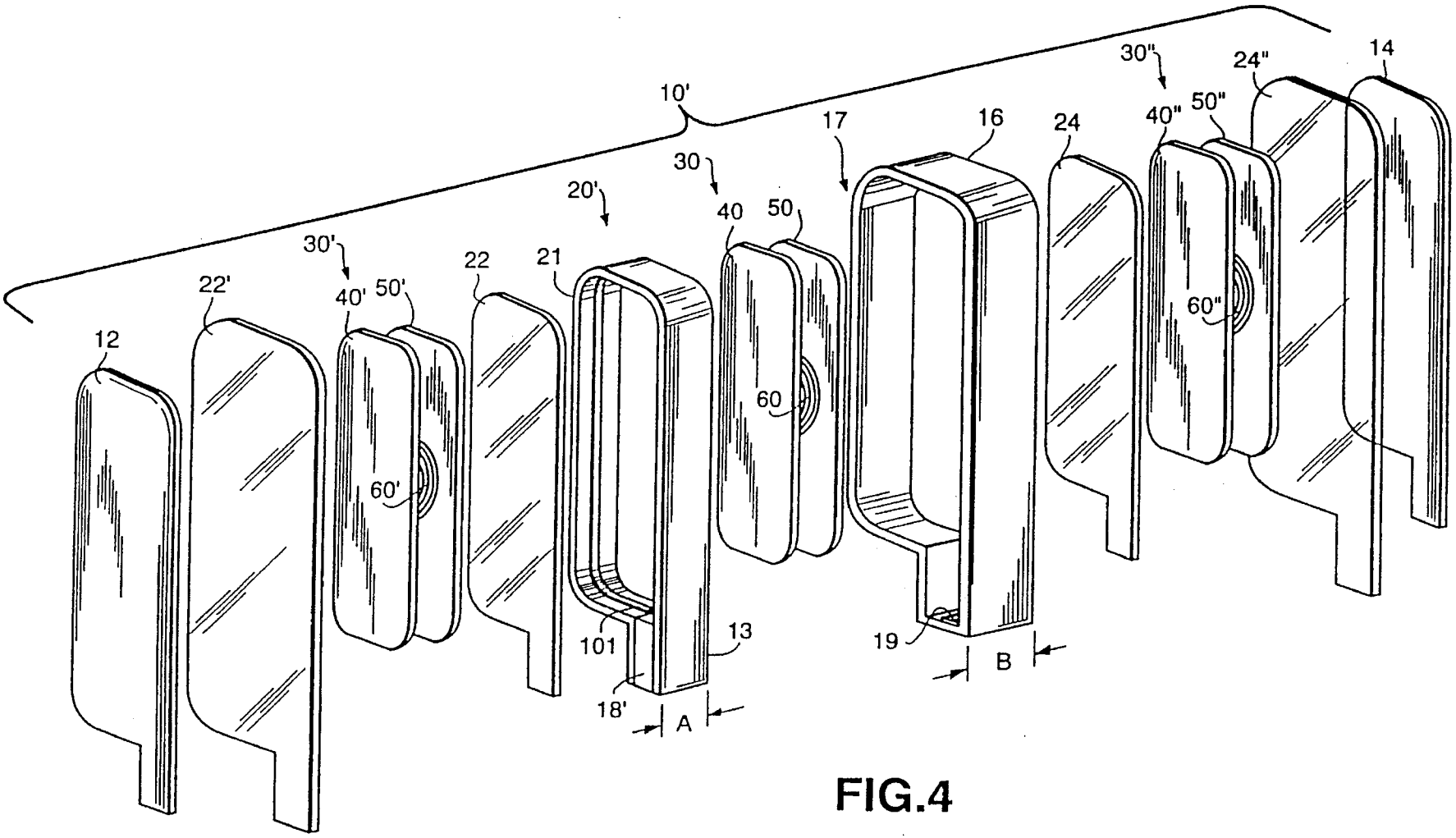
FIG. 4 is an exploded, perspective view of an alternative embodiment of the reservoir structure for use with the present invention.
Figure 5:
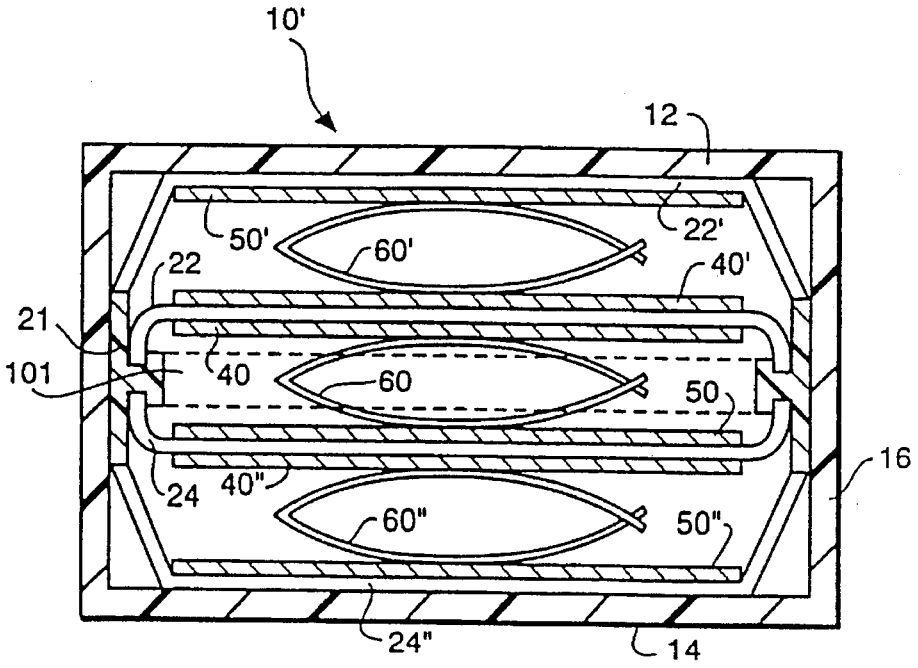
FIG. 5 is a cross-sectional plan view of an embodiment of the cartridge of the present invention using the reservoir structure of FIG. 4.

An alternative embodiment of the reservoir structure 10 is shown in FIGS. 4 and 5. Such an embodiment is useful in color printer applications which generally use three colorants—such as yellow, magenta and cyan—to create a full range of print color combinations.

An ink-jet cartridge structure 10' adapted to accommodate multiple reservoir sections can be constructed by the modification of the structure 10 as shown in FIG. 1. In a preferred embodiment for full color printing, a three reservoir system is created by adding two additional regulators 30', 30". Each additional regulator substantially mimics the original. For example, added regulator 30' has sideplates 40', 50' and an interposed spring 60'. The added regulators 30', 30" are interspersed between two additional reservoir membranes 22' and 24", respectively, that are added in order to form a tri-reservoir system.

Inner frame 20' can, for example, consist of two half-sections on which to fixedly mount the reservoir membranes with their respective interposed regulators. [For example, in a further envisioned embodiment, a third inner frame section could be interposed between the other two sections and between center reservoir membranes (encompassing the center regulator) and appropriate design variable adjustments made to increase, or decrease, the capacity of all three ink reservoir sections.] However, in the preferred embodiment, a two-shot molded form where inner frame 20', having a cross dimension A less than wall section 16 cross dimension B of outer housing 17, is integrally molded approximately centrally within outer frame 17. The exact dimensions are predetermined based upon the reservoir volumes desired, manufacturing tolerances, and other design factors that will be apparent to a person skilled in the art.

The reservoir membranes 22, 22', 24, 24", are sized in a predetermined design to hold chosen volumes of each colorant, which may be equal or different. Though depicted in a taut configuration, it should be recognized that, for example, the outer membrane 22' is designed to be affixed, such as by heat welding, to form a seal with edge 21 of inner frame 20'. The outer membrane is pre-shaped to be pressed against the cover plate 12 by the regulator plate 40' when the reservoir is filled and, further, to be collapsible to a maximum extent possible into the inner frame 20' when the ink is thoroughly depleted through the printing process. Similarly, the inner reservoir membrane 22 (which was affixed to inner frame 20 edge 21 as shown in FIG. 1) is differently shaped and somewhat smaller than outer membrane 22' because it is now adapted to be affixed to an inner ridge 101 of inner frame 20' in accordance with predetermined design expedients.

Again, while the membranes depicted appear taut, it is to be recalled that in practice the four membranes 22, 22', 24, 24" are flexible films and thus the volumetric capacity of each individual ink reservoir section can be approximately identical or different through the choice of appropriate design variables. In general, these films comprise a laminate of a copolymer of polypropylene and polyethylene sandwiching a metal film or composite, such as CURLAM (a registered trademark) commercially available from Curwood, Inc.

The regulator devices, 30, 30', 30" are also designed with predetermined variables, such as pressure plate shape and spring constants, to meet the needs of the particular printer with which the ink cartridge 10 is to be used. The cartridge 10 can thus be "tuned" to the designers' needs.

Figure 6A:
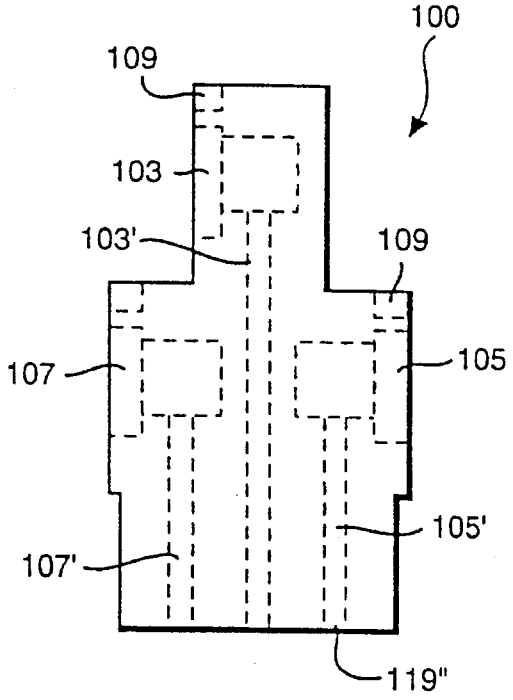
FIG. 6A is a plan view (front) of a filter snout structure adaptable to the alternative embodiment of the present invention as shown in FIG. 5.
Figure 6B:
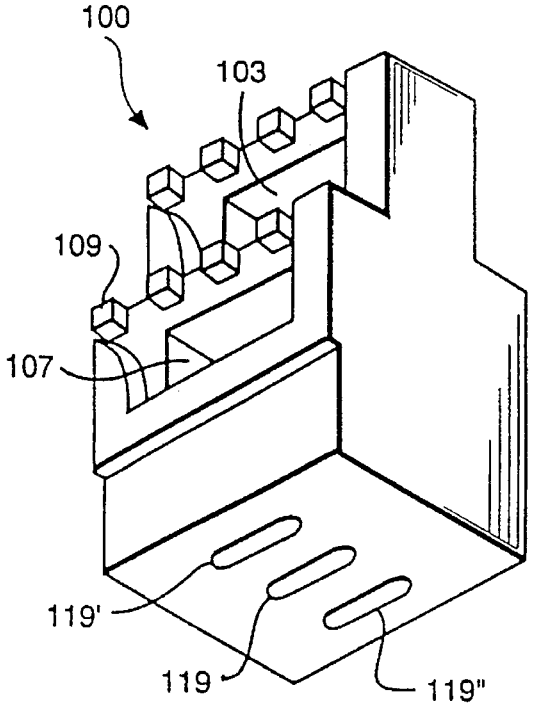
FIG. 6B is a perspective view of the filter snout structure as shown in FIG. 6A.

As shown in FIGS. 6A & 6B, in accordance with the tri-reservoir structure modifications, the frame member 20' is modified to provide a port and filter system for each separate reservoir.

A snout plug 100 (which may be integrally molded with inner frame 21 of FIG. 4) provides one ink inlet port for each reservoir formed within outer housing 17, respectively labelled with numerals 103, 105 and 107. Each of the three reservoirs is in fluid communication with only one inlet port and, via an individual channel 103', 105', 107', to a respective outlet port 119, 119", 119'. Each inlet port 103, 105, 107 can include a separate filter 18 (not shown). Nibs 109 are provided to prevent complete collapse of the reservoir membrane onto the filters 18 and restricting or interrupting ink flow therethrough.

In the embodiment of the tri-reservoir ink cartridge 10', as shown in FIG. 5, the coil spring type regulator spring 60 of FIGS. 1 and 4 have been replaced with a double leaf spring structure 60'. Such springs mechanisms are discussed in co-pending application Ser. No. 07/928,811, filed Aug. 12, 1992, (Khodapanah et al.), referenced and incorporated above.

As will be readily recognized by a person skilled in the art, the design disclosed herein can be simply modified to provide only two compartments, eliminating parts and lower costs for two color applications (e.g., black and red), or expanded to provide more than three ink reservoir compartments (e.g., black and three colors) by the addition of redundant inner frames, reservoirs, films, and regulators. Similarly, to simplify the design and assembly, inner frame members might be eliminated by the use of ridges on the internal surface of the inner frame 20 of the cartridge 10 to which to affix the reservoir membranes.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. An ink reservoir structure for an ink-jet printing cartridge, having an ink discharge aperture device coupled thereto, said structure comprising:

a substantially rigid frame having a pair of peripherally extending edges on opposite sides thereof and at least a first ink discharge port and a second ink discharge port therethrough;

at least three flexible, ink-impervious membranes, each of said membranes having a periphery, said membranes being sealingly joined only about each respective periphery, thereby forming at least a first ink reservoir and a second ink reservoir by sharing a central one of said membranes, wherein said first ink reservoir and said second ink reservoir are in fluid communication with said first ink discharge port and said second ink discharge port, respectively; and a first ink pressure regulator means within said first ink reservoir coupled to a first one of said membranes and said central one of said membranes, and a second ink pressure regulator means within said second ink reservoir coupled to said central one of said membranes and a third one of said membranes, each of said first pressure regulator means and second ink pressure regulator means for urging adjacent membranes apart from each other such that a negative pressure is maintained at said ink discharge aperture device.

2. The structure as set forth in claim 1 wherein said membranes are joined to said frame to form a fluid tight seal thereto.

3. The structure as set forth in claim 1, wherein said first ink pressure regulator means and said second pressure regulator means are adapted to maintain negative pressure in each said first ink reservoir and said second ink reservoir with respect to said first ink discharge port and said second ink discharge port, respectively.

4. The structure as set forth in claim 3 wherein each said first ink reservoirs and said second ink reservoirs contains an individual pressure regulator having a predetermined negative pressure setting value.

5. The structure as set forth in claim 3 wherein each of said regulator means comprises:

a pair of spaced, substantially parallel, flat-sided plates abutting said adjacent membranes, respectively, and means for urging said plates apart from each other and into engagement with adjacent membranes.

6. The structure as set forth in claim 5 wherein each of said plates is bonded to a respective adjacent membrane.

7. An ink-jet hard copy apparatus ink cartridge device, containing ink reservoirs adapted to maintain ink under a negative pressure with respect to an ink discharge aperture device connected to said ink cartridge device, said ink cartridge device comprising:

a substantially rigid housing having a pair of peripheral edges on opposite sides thereof, a pair of cover plates, wherein each of said cover plates is adapted to mate with one of said peripheral edges to form an enclosure, and at least a first ink discharge port and a second ink discharge port through said housing;

at least three flexible, fluid impervious membranes, each of said membranes having a periphery, said membranes being sealingly joined together only about respective periphery within said housing to form a first ink reservoir and a second ink reservoir for holding a supply of ink within each of said reservoirs, wherein each said first ink reservoir and said second ink reservoir is adapted to be in fluid communication with one of said first ink discharge port and said second discharge port, respectively; and means for regulating pressure within each said first ink reservoir and said second ink reservoir, respectively, so as to maintain said negative pressure.

8. The device as set forth in claim 7, further comprising:

means within said housing for sealing said membranes in order to form said first ink reservoir and said second ink reservoir, such that each said first ink reservoir and said second ink reservoir has a predetermined shape and size.

9. The device as set forth in claim 8 wherein said means for sealing said membranes comprises an inner frame formed within said housing for sealingly mounting said membranes upon to form said first ink reservoir and said second ink reservoir, respectively.

10. The device as set forth in claim 9, further comprising:

means, within said housing, and being sealingly joined to the membranes, for maintaining an approximate predetermined peripheral shape and size for each said first ink reservoir and said second ink reservoir.

11. The device as set forth in claim 10, wherein said means for maintaining the approximate predetermined peripheral shape and size for each said first ink reservoir and said second ink reservoir formed by said membranes comprises a ridge located on an inner surface of said housing.

12. The device as set forth in claim 10, wherein said means for maintaining the approximate predetermined peripheral shape and size comprises an inner frame.

13. The device as set forth in claim 12 wherein said housing and said inner frame are formed of plastic and said inner frame is formed of a plastic that has a lower melting point than the plastic used to form said housing.

14. The device as set forth in claim 7 wherein each of said means for regulating pressure further comprises:

a pair of spaced, substantially parallel, side plates; and a spring means, mounted between said plates, for urging said plates apart from each other into engagement with at least two adjacent membranes.

15. The device as set forth in claim 7, wherein said housing further comprises:

a snout section having said first ink discharge port and said second ink discharge port therethrough, adapted for mounting said printhead thereon;

means for filtering ink outflow from said first ink reservoir and said second ink reservoir through said first ink discharge port and said second ink discharge port; and means, within said snout section, for holding said means for filtering, said means for holding having at least two inlet ports, two outlet ports, and two individual channels connecting each individual inlet port to a respective outlet port, such that each said first ink reservoir and second ink reservoir is in fluid communication with only one of said first ink discharge port and second discharge port through one of said means for filtering, respectively.

16. In an ink-jet cartridge for a printer, said cartridge having an ink reservoir housing and a ink discharge aperture device attached thereto having ink discharge orifices in fluid communication with three ink discharge ports in said housing, an improved, multiple compartment, ink reservoir system for containing different color inks comprising:

a first reservoir section, having a first collapsible bag of a predetermined shape and size and a first pressure regulator within said bag, connected to a first of said ink discharge ports;

a second reservoir section, adjacent said first reservoir section, having a second collapsible bag of a predetermined shape and size and a second pressure regulator within said bag, connected to a second of said ink discharge ports;

a third reservoir section, adjacent said second reservoir section, having a third collapsible bag of a predetermined shape and size and a third pressure regulator within said bag, connected to a third of said ink discharge ports; and a pressure regulator mechanism within each of said reservoir sections that maintains a negative pressure with respect to said ink discharge aperture device.

17. The system as set forth in claim 16, wherein adjacent collapsible bags share a common wall therebetween.

18. The system as set forth in claim 16, wherein each said pressure regulator can be tuned to provide equal or different negative pressure in the reservoir sections.

19. The system as set forth in claim 16, further comprising:

means within said housing for maintaining each reservoir section in predetermined peripheral shape and size.

* * * * *